United States Patent [19]

Kanaya et al.

[11] Patent Number: 5,045,671

[45] Date of Patent: Sep. 3, 1991

[54] OVEN USING HALOGEN LAMPS

[75] Inventors: Yoshihiro Kanaya; Makoto Morishima, both of Nagoya, Japan

[73] Assignee: Rinnai Kabushiki Kaisha, Japan

[21] Appl. No.: 524,204

[22] Filed: May 16, 1990

[30] Foreign Application Priority Data

May 19, 1989 [JP] Japan ..... 64-57763

[51] Int. Cl.[5] ..... A21B 1/00

[52] U.S. Cl. ..... 219/411; 219/405; 219/400

[58] Field of Search ..... 219/405, 411, 393, 395, 219/396, 398, 408, 412, 414, 400

[56] References Cited

U.S. PATENT DOCUMENTS 2,654,824 10/1953 Schroeder ..... 219/398
3,625,197 12/1971 Pirker ..... 219/413
3,699,307 10/1972 Malkin ..... 219/412
3,792,801 2/1974 Baker ..... 219/398
4,345,145 8/1982 Norwood ..... 219/408
4,481,404 11/1984 Thomas ..... 219/398

*Primary Examiner*—Teresa J. Walberg
*Attorney, Agent, or Firm*—Nilsson, Robbins, Dalgarn, Berliner, Carson & Wurst

[57] ABSTRACT

In an oven having a plurality of heat sources for cooking by heating an object of cooking inside an oven chamber, the capacities of said heat sources are arranged to be capable of independent control. The operating time of the heat sources is arranged to be set by a timer, wherein heat sources not operated or operated at a reduced capacity are operated substantially at their full capacities for a predetermined period of time after a cooking time set by the timer has elapsed.

3 Claims, 4 Drawing Sheets

OVEN USING HALOGEN LAMPS

BACKGROUND OF THE INVENTION

1. Field of the Invention

This invention relates to an oven to be used mainly in the home.

2. Description of Related Art

Conventionally, an oven having a plurality of heat sources for cooking a material inside an oven chamber is known in, for example, JP-B-34426/1988.

SUMMARY OF THE INVENTION

In this kind of oven, when part of the heat sources is not operated or operated at a reduced capacity depending on the kind of cooking in order to perform various kinds of cooking, oils and the like scattering from the object of cooking during cooking are caused to adhere to the heat sources not operated or operated at a reduced capacity, resulting in a disadvantage in that a smell is generated by the burning of the oils when the oven is used next time.

This invention has an object of providing an oven without this kind of disadvantage.

In order to attain this object an oven in accordance with this invention is of the type that it has a plurality of heat sources for cooking by heating a material inside an oven chamber, the capacities of the heat sources being arranged to be capable of independent control, the operating time thereof being arranged to be set by a timer, wherein heat sources not operated or operated at a reduced capacity are operated substantially at their full capacities for a predetermined period of time after a cooking time set by the timer has elapsed.

An oven in accordance with this invention is of the type that it has a plurality of heat sources for cooking by heating a material inside a grill chamber, the capacities of the heat sources being arranged to be capable of independent control, the operating time thereof being arranged to be set by a timer, wherein heat sources not operated or operated at a reduced capacity are operated substantially at their full capacities for a predetermined period of time before a cooking time set by the timer elapses.

An oven in accordance with this invention is characterised in that the heating sources are halogen lamps.

In the oven having the abovementioned construction, since the heat sources not operated or operated at a reduced capacity are made to operate substantially at their fully capacities for a predetermined period of time after or before the cooking time set by the timer expires, the oils and the like adhered to the heating sources can be burned off during this period of time.

When the halogen lamps are used as the heating sources, the surface temperatures of the heat sources are particularly high and the burning off can be performed in a short period of time.

BRIEF DESCRIPTION OF THE DRAWINGS

An embodiment of this invention is described, by way of example, with reference to the drawings in which.

DESCRIPTION OF THE PREFERRED EMBODIMENT

Figure 1:
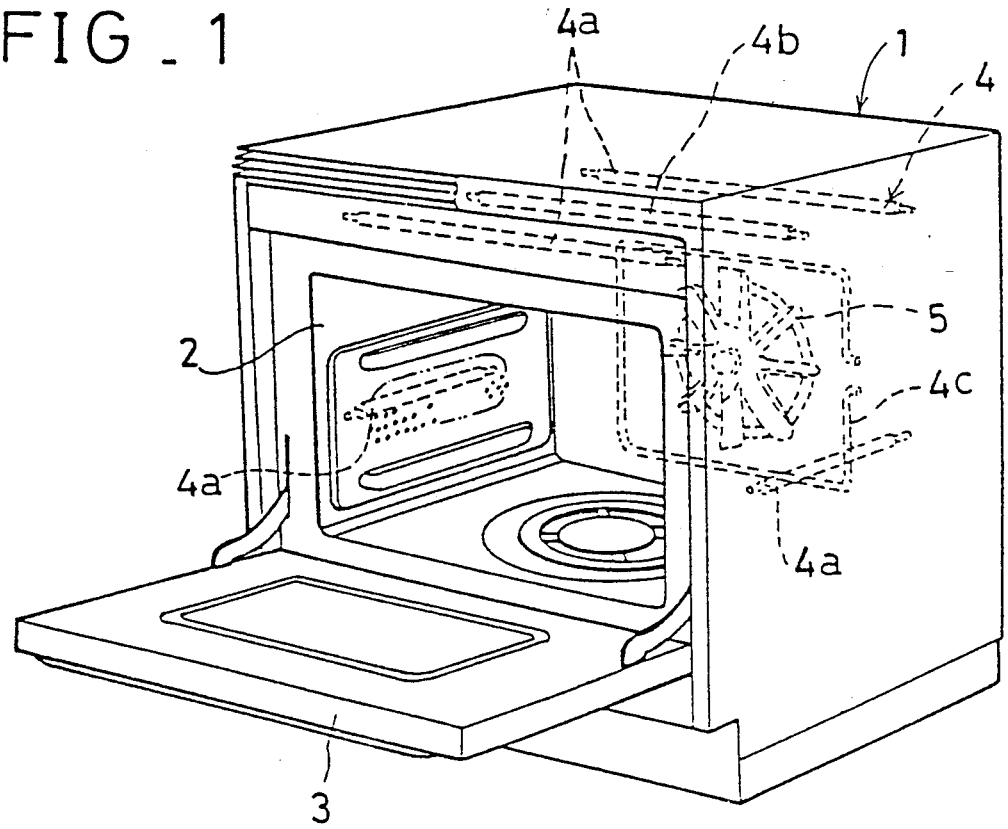
FIG. 1 is a perspective view of one embodying example of this invention.
Figure 2:
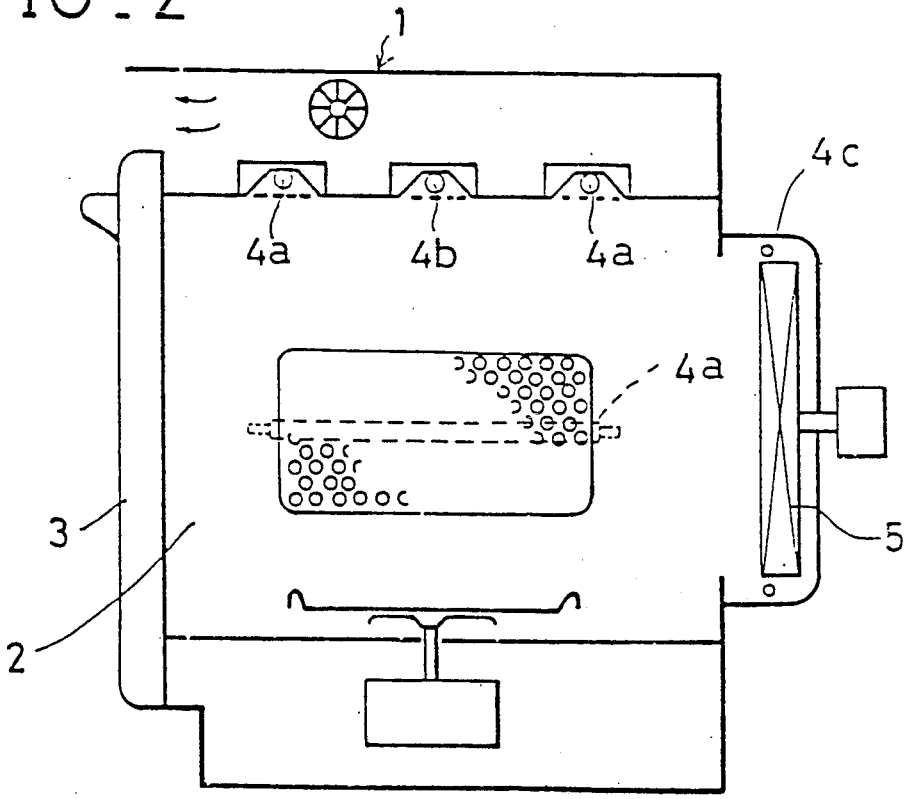
FIG. 2 is a sectional side view thereof.
Figure 3:
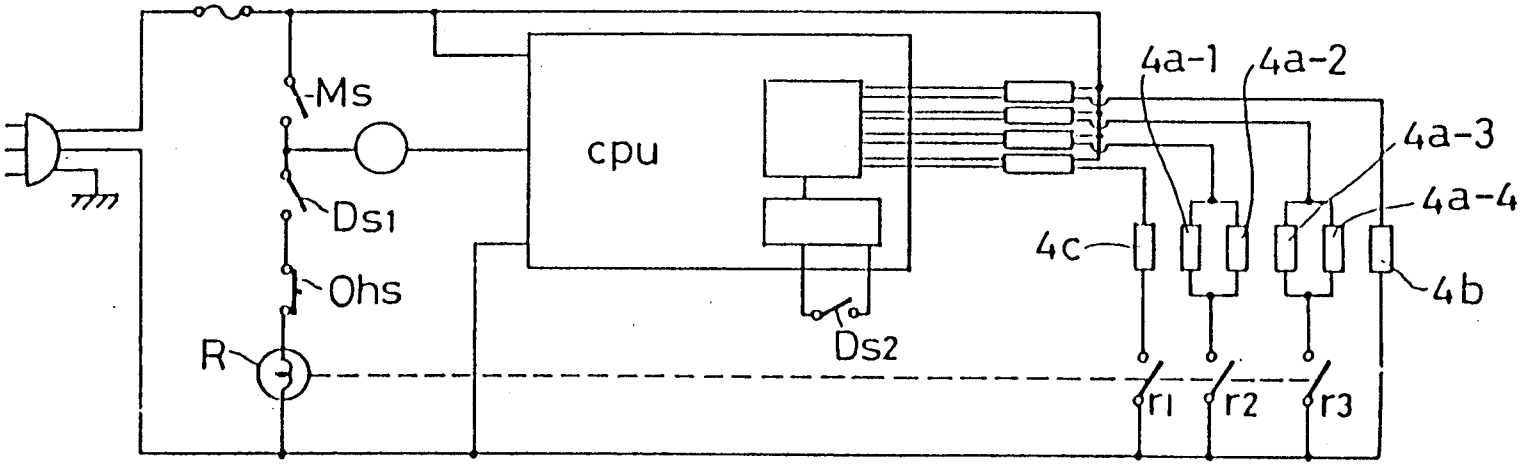
FIG. 3 is a diagram showing a control circuit thereof.

Referring to the drawings, there are shown an oven main body 1, an oven chamber 2 provided in the oven main body 1, a door 3 which is provided at the front side of the oven chamber 2 and which can be opened and closed, and heat sources 4 provided in the grill chamber 3. These heat sources 4 comprise halogen lamps **4*a* with a far infrared coating which are disposed on both sides of, and in the front and the rear portions of the ceiling of, the oven chamber 2, respectively, a halogen lamp 4*b* without the coating which is disposed between the halogen lamps 4*a*, 4*a* on the ceiling, and a sheath heater 4*c* which is disposed in the rear of the oven chamber 2 to enclose a fan 5 inside the chamber. For each of the heat sources 4 there is an operating time respectively set by a timer and also the capacity respectively controlled. This invention is so arranged that the heat sources 4 which are operated or operated at a reduced capacity are operated at their full capacities for a predetermined period of time after or before the expiration of cooking time which is set in the timer. Its control is made by a control circuit shown in FIG. 3 which is explained below. The halogen lamp 4*b* without the far infrared coating is controlled by a CPU which is connected to a power source via a main switch Ms. The halogen lamps 4*a* with the far infrared coating and the sheath heater 4*c* are controlled by the CPU which is connected to the power source via the main switch Ms as well as by relay contacts r1, r2 and r3 of a relay R which is connected to the power source via the main switch Ms, a door switch Ds1 and a normally closed switch $\overline{\text{Ohs}}$ which is opened in an interlocking relationship with an overheating protection device. In FIG. 3 reference numerals 4*a*-1 and 4*a*-2 denote halogen lamps disposed on the sides of the oven chamber and 4*a*-3 and 4*a*-4 denote halogen lamps disposed on the ceiling thereof. The CPU is provided with a phase control function, a timer function and a detection function for detecting the opening of the door switch Ds2**.

Figure 4:
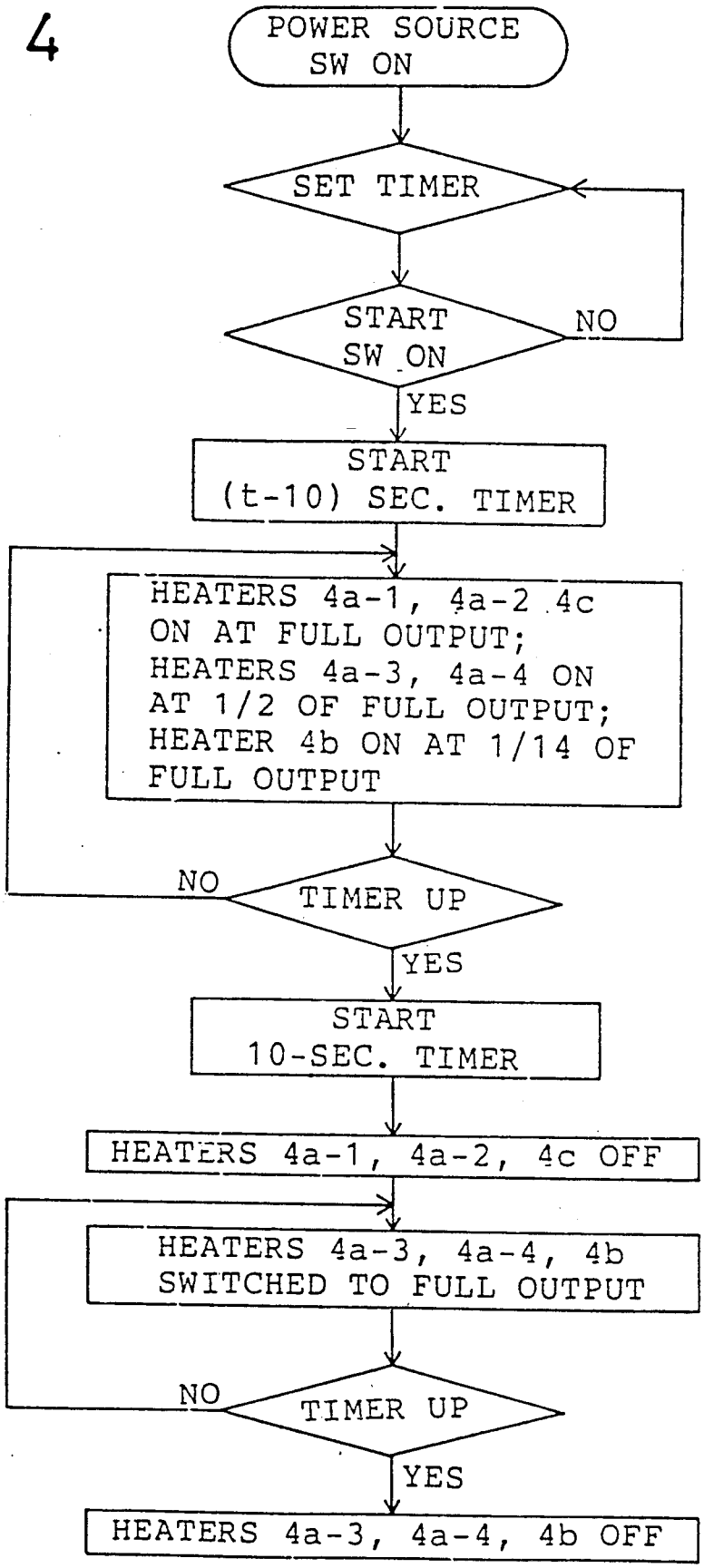
FIGS 4 and 5 are flow charts.
Figure 5:
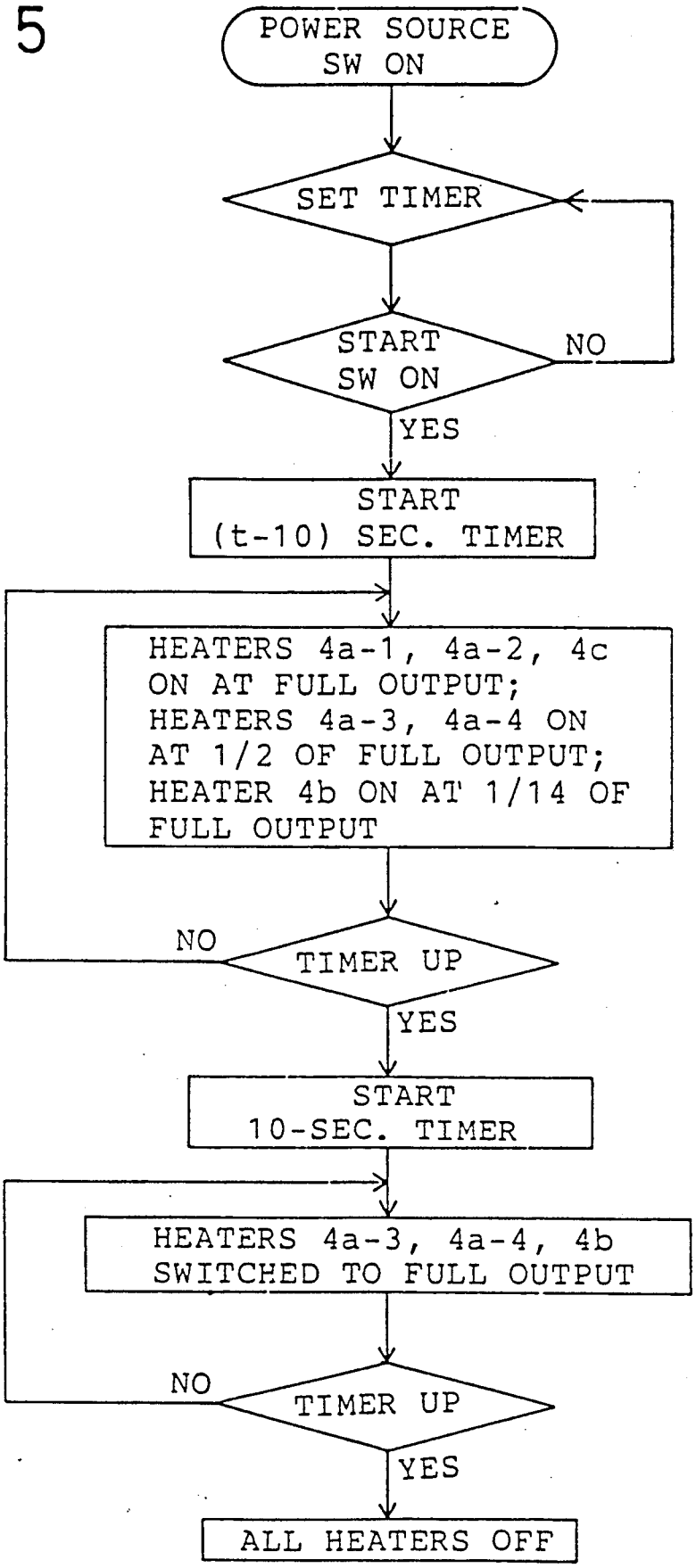

Next, an explanation is given regarding oven cooking and grill cooking in both of which the adhesion of the oils to the heat sources 4 becomes a problem. In oven cooking, as shown in the flow chart of FIG. 4, the capacities of the halogen lamps **4*a*-3, 4*a*-4 with the far infrared coating are set at ½ of a total output of 700W and, at the same time, the output of the halogen lamp 4*b* without the coating is also lowered to 50W which corresponds to 1/14 of the total output of 700W. The other heat sources 4 are operated at their maximum capacities to maintain the temperature inside the oven chamber at 160° to 250° C. At this time the fan 5 inside the oven chamber is also operated. It is therefore so arranged that the halogen lamps 4*a*-3, 4*a*-4 and 4*b* are operated at their maximum capacities for a predetermined period of time, e.g., for 10 seconds, after the lapse of the cooking time set by the timer, i.e., t-10 seconds as shown in FIG. 4 to maintain the surface temperatures of the lamps 4*a*-3, 4*a*-4, 4*b* at 500° C. or above, thereby burning off the oils and the like which are generated out by the material being cooked and which are adhered to the surfaces of the heat sources. In other words, the oils and the like which are adhered to the surface of the heat sources are made to burn off in a predetermined period of time after the lapse of the cooking time. This burning off can, however, be performed in a predetermined period of time, e.g., in 10 seconds, before the lapse of the cooking time t. Int his case, the heat sources 4** which are operating at their full capacities may be stopped before the start of the above mentioned 10 seconds.

In grill cooking only the sheath heater 4c is stopped and the other heat sources 4 are operated at their full capacities, and by stopping the operation of the fan 5 inside the oven chamber the temperature inside the oven chamber is maintained at about 300° C. for performing cooking. Therefore, it is so arranged that the sheath heater 4c which is not operated is made to operate at its maximum capacity for a predetermined period of time after the lapse of the cooking time set by the timer, thereby burning off the oils or the like adhered to the surfaces of the heat sources during cooking. However, this burning off can also be performed in a predetermined period of time immediately before the lapse of the cooking time, in the same manner as in the oven cooking.

Although the above-mentioned heat sources 4 are explained as halogen lamps and a sheath heater, it is needless to say that the heat sources 4 may also be gas burners.

As regards the cooking time to be set by the timer, the cooking time itself may also be set, or else the setting may be made inclusive of the time for burning off the adhered oils and the like. A reduction in the cooking capacity is attained, when the heat sources 4 are lamps, either by reducing the wattage or by repeatedly switching on and off the lamps. The reduction of the cooking capacity by switching on and off the lamps is especially effective in the case where the heat sources 4 are in a switched off condition at the end of cooking operation.

The oven of this invention has the following effects.

In the oven of the invention, by operating the heat sources which are not operated or operated at reduced capacities substantially at their maximum capacities for a predetermined period of time after or before the lapse of the cooking time set by the timer, the oils and the like adhered to the heat sources can be burned off during this period of time. If the heat sources are halogen lamps, the surface temperatures thereof are high and, therefore, the oils and the like can be burned off in a short time.

We claim:

1. An oven having a plurality of heat sources for cooking by heating a material inside an oven chamber, the capacities of said heat sources being arranged to be capable of independent control, the operating time thereof being arranged to be set by a timer, wherein heat sources not operated or operated at a reduced capacity are operated substantially at their full capacities for a predetermined period of time after a cooking time set by the timer has elapsed.

2. An oven having a plurality of heat sources for cooking by heating a material inside an oven chamber, the capacities of said heat sources being arranged to be capable of independent control, the operating time thereof being arranged to be set by a timer, wherein heat sources not operated or operated at a reduced capacity are operated substantially at their full capacities for a predetermined period of time before a cooking time set by the timer elapses.

3. An oven according to any of claims 1 and 2, wherein said heat sources are halogen lamps.

* * * * *